United States Patent [19]

Gamber

[11] 4,002,338

[45] Jan. 11, 1977

[54] AMUSEMENT GAME DEVICE

[75] Inventor: William V. Gamber, Huron, S. Dak.

[73] Assignee: Jerry D. Elias

[22] Filed: June 12, 1975

[21] Appl. No.: 586,365

[52] U.S. Cl. ..... 273/122 A; 273/85 F; 273/129 D

[51] Int. Cl.[2] ..... A63F 7/06; A63F 7/10

[58] Field of Search ..... 273/119 R, 119 A, 122 R, 273/122 A, 125 R, 125 A, 129, 85 A, 85 B, 85 C, 85 D, 85 F

[56] References Cited

UNITED STATES PATENTS

| | | | |
|---|---|---|---|
| 2,237,486 | 4/1941 | Henderson | 273/119 R X |
| 3,087,731 | 4/1963 | Waite | 273/119 R |
| 3,391,937 | 7/1968 | Seiden | 273/129 |

FOREIGN PATENTS OR APPLICATIONS

| | | | |
|---|---|---|---|
| 1,071,526 | 3/1954 | France | 273/119 R |
| 640,797 | 6/1962 | Italy | 273/85 C |
| 6,400,594 | 7/1964 | Netherlands | 273/85 C |
| 221,463 | 11/1942 | Switzerland | 273/85 D |

*Primary Examiner*—Anton O. Oechsle
*Attorney, Agent, or Firm*—Henderson, Strom & Sturm

[57] ABSTRACT

An amusement game device played by two people having an arcuate playing surface supported above the surface of the ground by a support system, a plurality of holes formed in the playing surface at opposite lower ends thereof, a flipper device movably mounted on each end proximate each set of holes for propelling a ball from the lower end over the top of the surface and to the opposite lower end with the object of causing the ball to enter a hole on the opponent's end of the board, a return ball system mounted under the playing surface and communicable with the holes on each end and operable at a predetermined time to return one half of the total number of balls to each end.

8 Claims, 4 Drawing Figures

FIG. 2
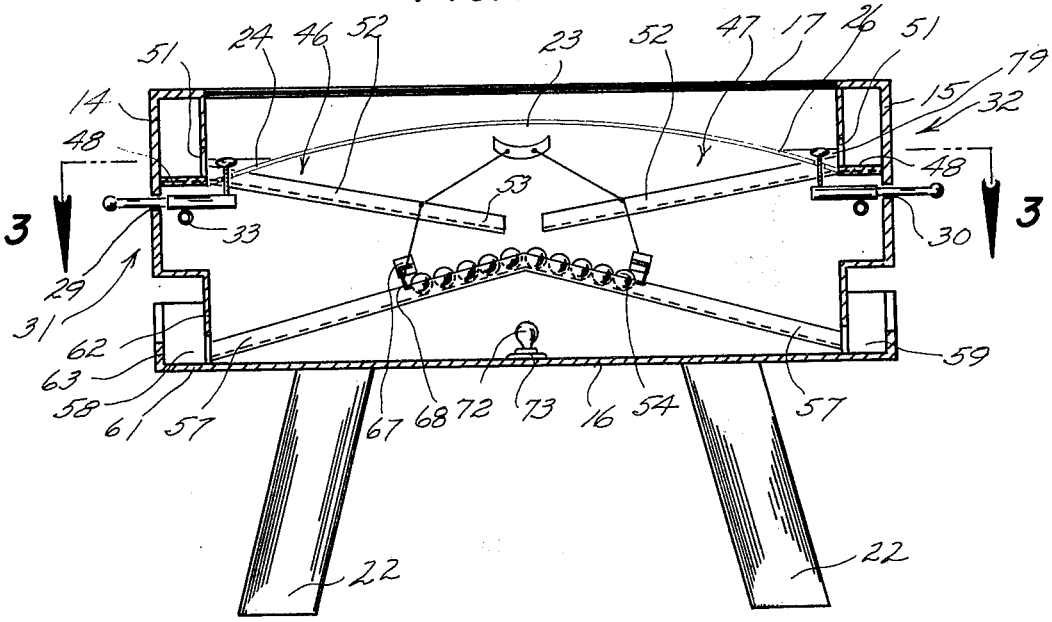
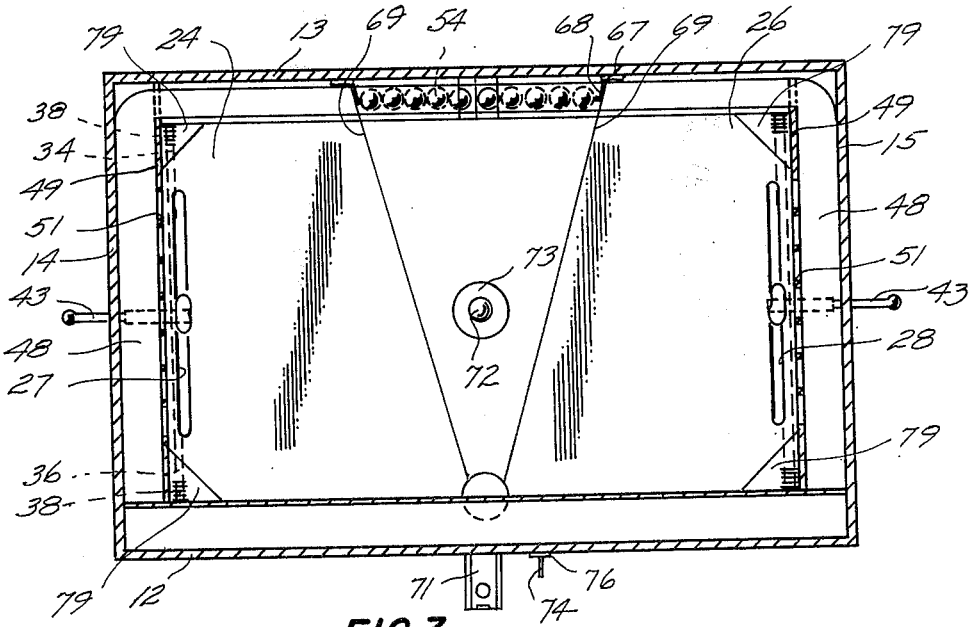
FIG.3

AMUSEMENT GAME DEVICE

BACKGROUND OF THE INVENTION

A plurality of amusement game devices have been developed which requires skill to move an object from one side of a board to another side wherein two players can complete against each other. These devices are found in game rooms, drug stores, restaurants and the like and are provided primarily for the amusement of patrons. The games normally have coin operated devices to supply the balls to the players and the skill of a player determines the winner.

SUMMARY OF THE INVENTION

This invention relates generally to amusement devices and particularly to a device having an arcuate surface which is higher in the center than on either of its two ends. The surface having a plurality of holes found therein proximate each end, a novel flipper device movably mounted at each end proximate the set of holes, a novel ball return device mounted under the surface and a coin operated device connected to the ball return device for returning a predetermined number of balls to each end.

It is an object of this invention to provide an amusement game device which is novel; and which utilizes an arcuate shaped playing surface over which a ball can be rolled, a flipper device mounted on each end of the surface for propelling the ball to the opposite end, and a plurality of holes formed in the surface into which the ball is rolled.

Yet another object of this invention is the provision of an amusement game device which is played by two competing players.

Still another object of this invention is the provision of a game of amusement for two competing players which requires skill and practice, yet which children or adults can play and enjoy.

A further object of this invention is to provide an amusement game device which is simple of manufacture, sturdy of construction, economical to manufacture, and extremely functional in use.

These objects and other features and advantages become more readily apparent upon reference to the following description when taken in conjunction with the appended drawings.

In the drawings, as hereinafter described, a preferred embodiment of the amusement game device of this invention is shown, however, various modification and alternate constructions can be made thereto without departing from the true spirit and scope of the invention.

BRIEF DESCRIPTION OF THE DRAWINGS

FIG. 2 is a sectional view taken along the lines 2 — 2 in FIG. 1;

FIG. 3 is a sectional view taken along the lines 3 — 3 in FIG. 2; and

DESCRIPTION OF THE PREFERRED EMBODIMENT

Figure 1:
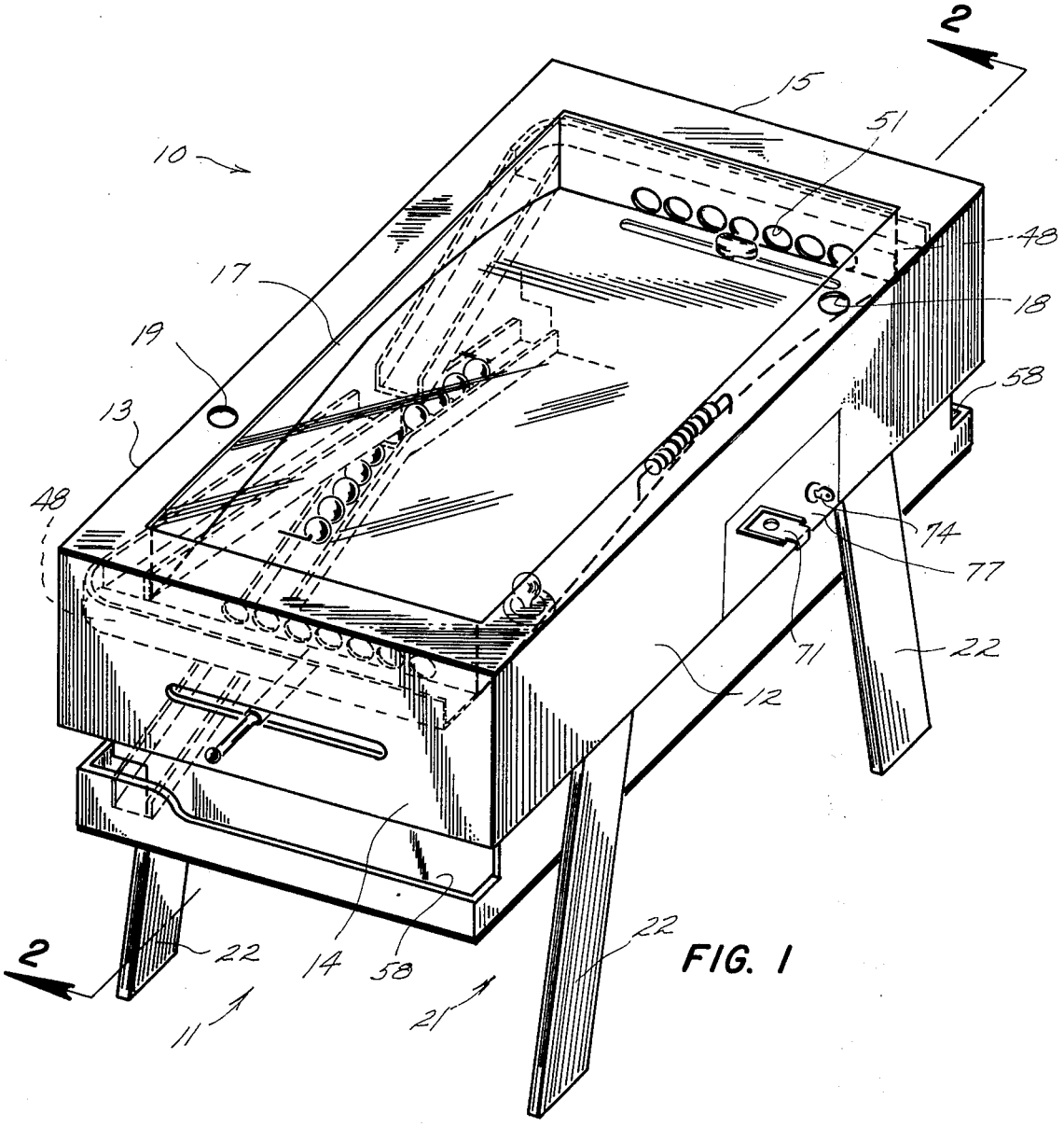
FIG. 1 is a perspective view of the amusement game device of this invention.

Referring now to the drawings, the amusement game device of this invention is shown generally at 10 in FIG. 1. The device comprises a rectangular frame 11 formed from a pair of vertically disposed parallel sidewalls 12 and 13 and a pair of parallel end walls 14 and 15, each secured at its ends to adjacent sidewalls. Interconnecting the sidewalls 12 and 13 at their lower edges is a bottom wall 16. Mounted on top of the side and end walls is a transparent cover 17, such as glass, having a pair of spaced holes 18 and 19 formed thereon. Each hole 18 or 19 is disposed proximate a sidewall 12 or 13 near one of the end walls 14 or 15. The frame 11 is supported above the ground by a support system 21 having a plurality of generally vertically disposed legs 22 each secured on one end to the sidewalls and having the other end disposed on the ground.

Mounted to the frame below the cover is an arcuate shaped transparent surface 23 (FIGS. 2 and 3) having depending ends 24 and 26 disposed proximate the end walls. A laterally disposed slit 27 and 28 is formed in the surface 23 proximate the ends 24 and 26. A slot 29 and 30 is formed opposite each other, below the slit, in the end walls 14 and 16.

Figure 4:
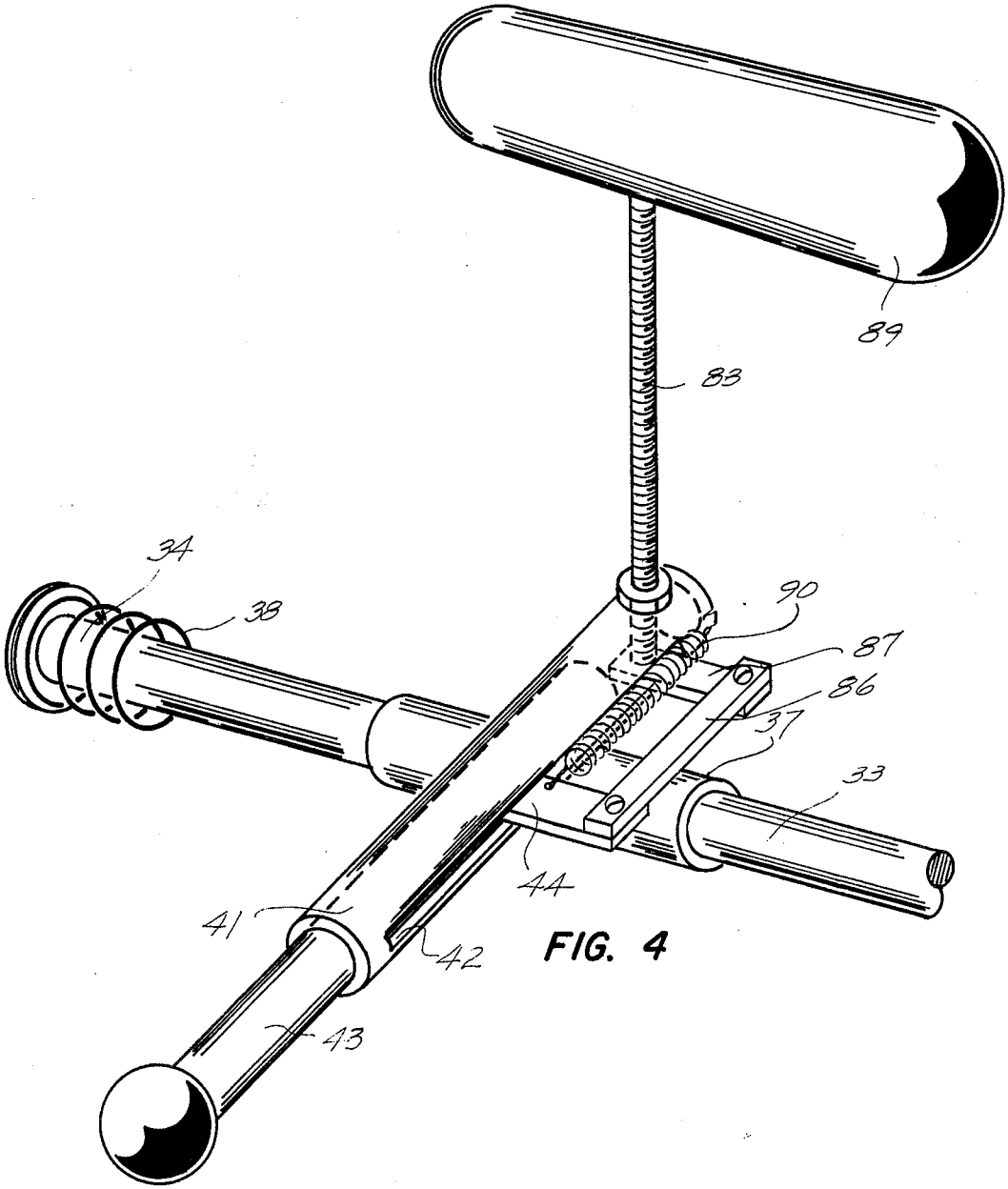
FIG. 4 is a perspective view of the flipper device.

A flipper device 31 and 32 (FIGS. 2 and 4) is mounted under the surface 23 proximate each end wall 14 and 16. As each flipper device is identical, only one will be described with like parts being identified by like numerals. The device 31 has a horizontally disposed rod 33 secured at its ends 34 and 36 to the sidewalls 12 and 13. Slidably mounted on the rod is a sleeve 37 and at each end 34 and 36 is a spring 38 and 39 respectively, for preventing the sleeve from striking a sidewall as it is moved back and forth across the rod. Secured transversely of the sleeve is tube 41 having a longitudinal slot 42 formed in one side thereof. Slidably mounted in the tube and projecting outwardly thereof is plunger 43 having one end of arm 44 secured radially thereof and projecting outwardly of the slot and radially of the tube. Pivotally secured to the free end of the arm is one end of a link 86 and pivotally secured to the other end of the link is one end of a short member 87. The other end of the member 87 is secured to a vertical post 88 which is pivotally secured on one end to the tube 41. The arm 44 is connected to the member 87 by a spring 90, thus biasing the plunger to a first position relative to the tube 41. Upon movement of the plunger to a second position, the flipper bar is pivoted in a horizontal plane. The post is disposed in the slit 27 or 28 and the free end of the plunger projects outwardly of the end wall.

Disposed above the flipper device on each end of the surface 23 (FIGS. 1 and 3) is a return ball device 46 and 47. Each return ball device has a sloping passage 48 disposed adjacent to and parallel with each surface end. A front vertical wall 49 having a plurality of horizontally spaced holes 51 formed therethrough separates the surface ends 24 and 26 from their respective passage 48. Each passage communicates with an upper ramp 52 having an upper end which connects with an end of the passage and a lower end 53 disposed proximate the midpoint between the two end walls. It will be noted that the lower ends 53 of the two upper ramps 52 terminate proximate each other, are substantially in longitudinal alignment, are disposed proximate one sidewall 13, and are spaced apart to permit a ball 54 to pass therebetween. Mounted directly below the two upper ramps 52, in vertical alignment, is an inverted V-shaped or lower ramp 56 which has its apex disposed immediately below and centrally located relative to the gap formed between the lower ends 53. The free ends 57 of the lower ramp terminate proximate the end walls 14 and 15 and communicate with a ball return pocket 58 or 59. Each ball return pocket 58 and 59 has a bottom wall 61, an inside wall 62 and an outside wall 63, the latter being in alignment with and spaced below the end wall 14 or 15.

Each return ball device 46 and 47 further includes a ball holding device (FIG. 2) having a gate 67 hingedly secured to the sidewall 13 proximate the lower ramps 52 on each side of the apex. Each gate has a proturbance 68 projecting therefrom over the ramp 52 wherein a ball will not pass thereover. The position of the gates 67 and protuberances 68 provides that an equal number of balls may be disposed on the ramps 52 each side of the apex with the balls in touching contact with the adjacent ball. The gates 67 are connected to one end of lines 69 and the other end of the lines are secured to conventional coin operated mechanism 71. Upon operation of the coin mechanism, the gates are moved by the lines from the first position holding balls on the ramp to a second position wherein the balls on the ramp roll to their respective pocket 58 or 59. Mounted on the bottom wall 16 is a bulb 72 and electric circuit 73 which is connected to a power source (not shown) to permit the lighting of the playing surface 23. A key 74 operated lock 76 and door 77 is formed in the sidewall 12 to permit removal of coins.

In operation the coin mechanism 71 is activated by placing a coin in the slot thereof and pushing the slot mechanism inwardly. Movement of the slot mechanism causes the line to move the gate from the first position to the second position thus allowing the balls on the ramp to roll to the pocket. A player places one of the balls 54 in the hole 18 or 19 disposed closest to his end of the surface 23 or goal. The ball will fall to the surface 23 and roll toward the player's own goal, lateral movement of the flipper device will bring the flipper 49 into proximity to the path of the ball 54 and skillful manipulation of the plunger 43 will cause the flipper 49, via the spring 50, to strike the ball and propel it toward the opponent's end, and hopefully into one of the holes 51 thus providing a score. The ball upon passing through the hole 51 enters the sloping passage 48 and the upper ramp 52. At the free end 53 of the upper ramp 52 the ball drops onto the lower ramp 56. If one player does all of the scoring, the sixth through the tenth ball will be properly aligned on the lower ramp because the positions of the gate devices. Mounted on the top of glass is a scoring element 78 for indicating the relative score of each player. Disposed on the four corners of the surface 23 are deflecting guides 79 for directing a rolling ball toward the center of the surface.

A modified front vertical wall 49 may be provided wherein instead of a plurality of holes 51, a longitudinal slot is formed therethrough through which a ball passing by the flipper bar will pass to reach the passage 48 of the return ball device.

I claim:

1. An amusement game device comprising:

support means;

frame means secured to said support means;

a longitudinal arcuate playing surface having depending ends mounted in said frame means;

a pair of spaced goal means secured to said frame means with one of said goal means disposed proximate each end of said playing surface;

at least one ball rollerably supported on said playing surface;

a pair of flipper means mounted in said frame means with one of said flipper means disposed proximate each goal means for striking said ball and propelling it away from said goal means on one end of said playing surface and toward said goal means on the other end of said playing surface;

wherein each said flipper means includes a rod disposed transversely of said playing surface and secured on its ends to said frame means; a sleeve slidably mounted on said rod; a tube transversely secured to said sleeve; a plunger slidably mounted in said tube and having one end projecting axially thereof; a vertically disposed post pivotally secured on one end to said tube; a flipper bar secured to the other end of said post and disposed above said playing surface proximate said goal means; and a linkage having one end secured to said plunger and having another end thereof secured to said post, wherein movement of said plunger causes said linkage to pivot said post and the said flipper bar from a first position to a second position.

2. An amusement game as defined in claim 1 wherein said tube has a longitudinal slot formed therein and said linkage includes an arm secured on one end to said plunger and projecting radially thereof through said slot, a link having one end pivotally secured to the other end of said arm and having the other end thereof disposed proximate said post one end, a member having one end pivotally secured to said other end of said link and having another end secured to said post one end, and a spring interconnected between said tube and said arm to bias said flipper bar to said first position.

3. An amusement game device as defined in claim 2 and including a pair of springs mounted one on each end of said rod to cushion the movement of said sleeve at the ends of said rod.

4. An amusement game device as defined in claim 1 including a ball return means mounted under said playing surface and connected to said goal means for receiving said ball from said goal means.

5. An amusement game device as defined in claim 4 wherein said ball return means includes a sloping passage secured on one end to each said goal means; a pair of upper depending ramps, each secured on its upper end to one of said passages other end and having their lower end disposed proximate each other; an inverted V-shaped lower ramp having its apex disposed immediately below and midpoint between said upper ramps lower ends and having its free ends terminate below said depending end of said playing surface; and a pair of return pockets each communicating with one of said free ends of said lower ramp, wherein said ball will roll down said ramp into said pocket.

6. An amusement game device as defined in claim 5 including a pair of spaced ball holding devices mounted on said lower ramp one on each side of and equi-distance from said apex.

7. An amusement game as defined in claim 6 wherein each said ball holding device includes a gate hingedly connected to said frame means, a proturbance secured to said gate and an operating element secured to said gates to move them from a first position wherein said proturbance blocks said ramp to a second position wherein ramp is clear to permit said ball to roll thereon to said return pocket.

8. An amusement game as defined in claim 4 wherein said goal means includes a vertical wall mounted at each said depending end of said playing surface, each said vertical wall having a plurality of holes formed therein wherein said ball will pass therethrough from said playing surface to said passage.

* * * * *